US010961485B2

(12) United States Patent
Kingma et al.

(10) Patent No.: US 10,961,485 B2
(45) Date of Patent: Mar. 30, 2021

(54) AQUEOUS FORMULATIONS WITH GOOD STORAGE CAPABILITIES

(71) Applicant: BASF SE, Ludwigshafen am Rhein (DE)

(72) Inventors: Arend Jouke Kingma, Weisenheim am Sand (DE); Diana Neumann, Speyer (DE); Henning Urch, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 153 days.

(21) Appl. No.: 15/770,241

(22) PCT Filed: Nov. 2, 2016

(86) PCT No.: PCT/EP2016/076373
§ 371 (c)(1),
(2) Date: Apr. 23, 2018

(87) PCT Pub. No.: WO2017/080880
PCT Pub. Date: May 18, 2017

(65) Prior Publication Data

US 2018/0312782 A1 Nov. 1, 2018

(30) Foreign Application Priority Data

Nov. 11, 2015 (EP) ..... 15194066

(51) Int. Cl.

| | |
|---|---|
| ***C11D 1/72*** | (2006.01) |
| ***C11D 3/20*** | (2006.01) |
| ***C11D 3/33*** | (2006.01) |
| ***C11D 3/36*** | (2006.01) |
| ***C11D 3/00*** | (2006.01) |
| ***C11D 3/04*** | (2006.01) |
| ***C11D 3/16*** | (2006.01) |
| ***C11D 3/34*** | (2006.01) |
| ***C11D 7/26*** | (2006.01) |
| ***C11D 3/37*** | (2006.01) |
| ***C11D 7/34*** | (2006.01) |
| ***C11D 7/36*** | (2006.01) |
| ***C11D 7/32*** | (2006.01) |
| ***C11D 1/34*** | (2006.01) |
| ***C11D 7/08*** | (2006.01) |

(Continued)

(52) U.S. Cl.

CPC ..... *C11D 3/33* (2013.01); *C11D 1/02* (2013.01); *C11D 1/345* (2013.01); *C11D 1/66* (2013.01); *C11D 3/0073* (2013.01); *C11D 3/042* (2013.01); *C11D 3/164* (2013.01); *C11D 3/2006* (2013.01); *C11D 3/2041* (2013.01); *C11D 3/2065* (2013.01); *C11D 3/2075* (2013.01); *C11D 3/2086* (2013.01); *C11D 3/3409* (2013.01); *C11D 3/362* (2013.01); *C11D 3/3723* (2013.01); *C11D 7/08* (2013.01); *C11D 7/261* (2013.01); *C11D 7/263* (2013.01); *C11D 7/265* (2013.01); *C11D 7/3245* (2013.01); *C11D 7/34* (2013.01); *C11D 7/36* (2013.01)

(58) Field of Classification Search

CPC ..... C11D 1/345; C11D 3/2006; C11D 3/2041; C11D 3/2065; C11D 3/33; C11D 3/3723; C11D 3/0073; C11D 1/02; C11D 1/66

USPC ..... 510/238, 421, 426, 477, 480, 488, 499, 510/505, 506

See application file for complete search history.

(56) References Cited

U.S. PATENT DOCUMENTS 3,650,962 A * 3/1972 Werdehausen et al. ..... C08G 73/0206 510/303

4,578,208 A 3/1986 Geke et al.

(Continued)

FOREIGN PATENT DOCUMENTS

WO WO 2005/103334 A1 11/2005
WO WO 2008/138817 A2 11/2008

(Continued)

OTHER PUBLICATIONS

International Search Report dated Jan. 20, 2017, in PCT/EP2016/076373, filed Nov. 2, 2016.
U.S. Appl. No. 15/573,155, filed Nov. 10, 2017, US 2018-0105486 A1, Stamm, Armin, et al.
Extended European Search Report dated May 17, 2016 in European Patent Application No. 15194066.5.

*Primary Examiner* — Gregory R Delcotto
(74) *Attorney, Agent, or Firm* — Arent Fox LLP

(57) ABSTRACT

Aqueous formulations comprising (A) at least one organic complexing agent selected from (A1) alkali metal salts of aminopolycarboxylic acids and (A2) polymers bearing at least two —$CH_2$—N($CH_2$COOH)-units per molecule, partially or fully neutralized with alkali, (B) at least one salt of at least one of the following acids: nitric acid, sulphuric acid, sulphamic acid, methanesulfonic acid, $C_1$-$C_2$-carboxylic acids, $C_2$-$C_4$-hydroxymonocarboxylic acids, $C_2$-$C_7$-dicarboxylic acids, unsubstituted or substituted with hydroxyl, and $C_4$-$C_6$-tricarboxylic acids, each unsubstituted or substituted with hydroxyl, (C) at least one compound selected from (C1) phosphoric acid $C_2$-$C_{10}$-monoalkyl esters, (C2) a $C_3$-$C_{10}$-alkynol, optionally alkoxylated with one to 10 alkoxide groups per hydroxyl group, and (C3) a $C_4$-$C_{10}$-alkynediol, optionally alkoxylated with one to 10 alkoxide groups per hydroxyl group, said aqueous formulations having pH values in the range of from 7.5 to 10.

20 Claims, No Drawings

(51) Int. Cl.
*C11D 1/66* (2006.01)
*C11D 1/02* (2006.01)

(56) References Cited

U.S. PATENT DOCUMENTS

| | | | | |
|---|---|---|---|---|
| 6,827,795 | B1 * | 12/2004 | Kasturi | A61K 8/44 134/39 |
| 7,241,724 | B2 * | 7/2007 | Carnali | A61K 8/55 510/119 |
| 8,188,204 | B2 * | 5/2012 | Bergeron | A61K 8/416 162/164.6 |
| 2003/0027742 | A1 * | 2/2003 | Reierson | B01F 17/0064 510/510 |
| 2004/0242446 | A1 | 12/2004 | Mun et al. | |
| 2005/0205835 | A1 | 9/2005 | Tamboli et al. | |
| 2007/0042922 | A1 * | 2/2007 | Carnali | A61K 8/55 510/130 |
| 2008/0108539 | A1 | 5/2008 | Kany et al. | |
| 2012/0048295 | A1 | 3/2012 | Du et al. | |
| 2012/0065120 | A1 | 3/2012 | Kany et al. | |
| 2012/0260938 | A1 | 10/2012 | Zack et al. | |
| 2014/0080748 | A1 * | 3/2014 | Price | C11D 1/37 510/228 |
| 2018/0105486 | A1 * | 4/2018 | Stamm | C11D 3/33 |

FOREIGN PATENT DOCUMENTS

| | | | |
|---|---|---|---|
| WO | WO 2014/049633 | A1 | 4/2014 |
| WO | WO 2014/149633 | A1 | 9/2014 |
| WO | WO2014/191198 | * | 12/2014 |

* cited by examiner

AQUEOUS FORMULATIONS WITH GOOD STORAGE CAPABILITIES

The present invention is directed towards aqueous formulations comprising (A) at least one organic complexing agent selected from
  (A1) alkali metal salts of aminopolycarboxylic acids and
  (A2) polymers bearing at least two —$CH_2$—N($CH_2COOH$)-units per molecule, partially or fully neutralized with alkali, (B) at least one salt of at least one of the following acids: nitric acid, sulphuric acid, sulphamic acid, methanesulfonic acid, $C_1$-$C_2$-carboxylic acids, $C_2$-$C_4$-hydroxymonocarboxylic acids, $C_2$-$C_7$-dicarboxylic acids, unsubstituted or substituted with hydroxyl, and $C_4$-$C_6$-tricarboxylic acids, each unsubstituted or substituted with hydroxyl, (C) at least one compound selected from
  (C1) phosphoric acid $C_2$-$C_{10}$-monoalkyl esters,
  (C2) a $C_3$-$C_{10}$-alkynol, optionally alkoxylated with one to 10 alkoxide groups per hydroxyl group, and
  (C3) a $C_4$-$C_{10}$-alkynediol, optionally alkoxylated with one to 10 alkoxide groups per hydroxyl group, said aqueous formulations having pH values in the range of from 7.5 to 10.

Chelating agents of the aminopolycarboxylate type such as methyl glycine diacetic acid (MGDA) and glutamic acid diacetic acid (GLDA) and their respective alkali metal salts are useful sequestrants for alkaline earth metal ions such as $Ca^{2+}$ and $Mg^{2+}$. A lot of aminopolycarboxylates show good biodegradability and are thus environmentally friendly. For that reason, they are recommended and used for various purposes such as hard surface cleaners. Modern hard surface cleaners may be supplied as ready-to-use solutions and as concentrates. Ready-to-use solutions have the advantage that they may be used without further working steps such as dilution. However, a lot of water is shipped together with the active ingredient. For that reason, concentrates that enjoy the benefit of lower transportation costs are asked for in the market.

Concentrated solutions of chelating agents of the aminocarboxylate type are usually alkaline. They are strongly corrosive to some types of metal surfaces, for example, to aluminium. The types of corrosion most frequently observed are especially surface and pitting corrosion. Especially alkali metal salts of aminopolycarboxylic acid and of polymers bearing —$CH_2$—N($CH_2COOH$)— units, partially acidified or not acidified, may be detrimental to aluminium surfaces.

WO 2005/103334 discloses diluted solutions containing a surfactant, a complexing agent, and a source of alkalinity, for example $Na_2CO_3$, and their use for cleaning surfaces made from aluminium and surfaces made from coloured metals and alloys such as copper, brass, bronze, zinc, and bismuth.

In WO 2008/138817, biocide-containing formulations are disclosed that contain a biocide and a corrosion inhibitor. Such formulations are used in strongly diluted form for disinfection of medical devices. In WO 2014/49633, strongly diluted solutions of phosphorus-containing compounds are tested as corrosion inhibitors.

It was an objective of the present invention to provide alkaline solutions of complexing agents that may be transported in aluminium vessels without the inherent danger of corrosion. It was also an objective of the present invention to provide a process to make alkaline solutions of complexing agents that may be transported in aluminium vessels without the inherent danger of corrosion.

Accordingly, the aqueous formulations defined at the outset were found, hereinafter also referred to as "inventive formulations". Inventive formulations have a pH value in the range of from 7.5 to 10, preferably from 8.5 to 10, more preferably from 9 to 10 and even more preferably from 9.0 to 9.5.

Inventive formulations are aqueous formulations. In the context of the present invention, the term aqueous formulations does not only refer to solutions whose sole solvent is water but also to formulations that contain at least one non-aqueous solvent. Possible non-aqueous solvents need to me miscible with water at ambient temperature without phase separation. Examples are ethylene glycol, 1,2-propylene glycol, and $C_1$-$C_4$-alkanols such as ethanol and isopropanol. Water is the major solvent in inventive formulations, for example at least 50% by volume, referring to the sum of all solvents, preferably at least 90% by volume. Most preferably, only traces of non-aqueous solvent or no detectably amounts are contained in inventive formulations.

Inventive formulations contain (A) at least one organic complexing agent—hereinafter also referred to as component (A) or compound (A) or complexing agent (A)—selected from
  (A1) alkali metal salts of aminopolycarboxylic—acids hereinafter also referred to as component (A1) or compound (A1) or complexing agent (A1)—and
  (A2) polymers bearing at least two —$CH_2$—N($CH_2COOH$)-units per molecule, partially or fully neutralized with alkali. Such polymers are hereinafter also referred to as "polymers (A2)".

Alkali metal or alkali both refer to alkali metal cations such as lithium, sodium, potassium, rubidium and cesium and to combinations of at least two of the foregoing. Preferred alkali metals are sodium and potassium and combinations from sodium and potassium, for example 2:1 by mole to 10:1. Even more preferred is sodium. Traces—such as 100 ppm or less by weight—of alkali earth metals or transition metals such as Fe(+II) and Fe(+III) are neglected in the context of the present invention.

Within the context of the present invention, aminopolycarboxylic acids (A1) are understood as meaning nitrilotriacetic acid and other organic compounds that have a at least one tertiary amino group per molecule which bears one or two $CH_2$—COOH groups which—as mentioned above—can be partially or completely neutralized. Examples are alkali metal salts of nitrilotriacetic acid (NTA), ethylendiamine tetracetic acid (EDTA), diethylene triamine pentaacetic acid (DTPA), hydroxyethyl ethylendiamine triacetic acid (HEDTA), glutamic acid diacetic acid (GLDA) and methylglycine diacetic acid (MGDA).

In another embodiment of the present invention, aminopolycarboxylic acids (A1) are selected from organic compounds that bears at least one secondary amino group per molecule which has one or two CH(COOH)—$CH_2$COOH group(s) which—as mentioned above—can be partially or completely neutralized. Examples are alkali metal salts of iminodisuccinic acid (IDS).

Compound (A1) is employed as a salt, that means, at least one carboxylic acid group per molecule, preferably at least two and even more preferred an average of more than two carboxylic acid group per molecule is neutralized with alkali. In one embodiment of the present invention, compound (A1) is fully neutralized with alkali, for example with sodium. In other embodiments, compound (A1) is partially neutralized with alkali, for example, MGDA neutralized with from 2.2 to 2.8 equivalents of NaOH, or GLDA neutralized with from 3.1 to 3.8 equivalents of NaOH.

In one embodiment of the present invention, compound (A1) is selected from compounds according to general formula (I)

$$[R^1—CH(COO)—N(CH_2—COO)_2]M_{3-x}H_x \quad (I)$$

wherein

M is selected from alkali metal cations, same or different, and $CH_2CH_2COOM$ x is in the range of from zero to 0.8, preferably 0.1 to 0.75, $R^1$ is selected from $CH_2$—OH and $C_1$-$C_4$-alkyl, for example methyl, iso-propyl, sec.-butyl and isobutyl, preferably methyl.

In one embodiment of the present invention, compound (A1) is a compound according to the general formula $$[CH_3—CH(COO)—N(CH_2—COO)_2]M_{3-x}H_x$$

wherein x is in the range of from zero to 0.8, preferably from 0.1 to 0.75,

M is selected from potassium and sodium and mixtures thereof, preferably sodium.

In another embodiment of the present invention, compound (A1) is a compound according to (A1) is selected from compounds according to general formula (II)

$$[OOC—CH_2CH_2C—CH(COO)—N(CH_2—COO)_2]M_{4-x}H_x \quad (II)$$

wherein

M is selected from alkali metal cations, same or different, preferably potassium and sodium and mixtures thereof, even more preferably sodium, x is in the range of from zero to 0.8, preferably 0.1 to 0.75.

Some compounds (A1) such as MGDA and GLDA may exist in the form of two different enantiomers. In such embodiments, compound (A1) may be selected from the respective racemic mixtures and from enantiomerically pure compounds, preferably the respective L-isomers, and from enantio-enriched mixtures in which preferably the L-enantiomer predominates, for example in mixtures with an enantiomeric excess in the range from 10 to 95%.

In one embodiment of the present invention, compound (A) is selected from polymers (A2). Each $CH_2$—N—($CH_2$—COOH)-unit bears an additional substituent on the N, for example another methylene group or another $CH_2COOH$-group.

In a preferred embodiment, polymer (A2) is selected from polyamines, the N atoms being partially or fully substituted with $CH_2COOH$ groups, partially or fully neutralized with alkali metal.

The term "polyamine" in the context with polymer (A2) refers to polymers and copolymers that contain at least one amino group per repeating unit. Said amino group may be selected from $NH_2$ groups, NH groups and preferably tertiary amino groups. In polymer (B2), tertiary amino groups are preferred since the basic polyamine has been converted to carboxymethyl derivatives, and the N atoms are fully substituted or preferably partially, for example 50 to 95 mol-%, preferably 70 to 90 mol-%, substituted with $CH_2COOH$ groups, partially or fully neutralized with alkali metal cations. In the context of the present invention, such polymers (A2) in which more than 95 mol-% to 100 mol-% of the N atoms being subject to substitution in the corresponding polyvinylamine or polyalkylenimine are substituted with $CH_2COOH$ groups will be considered to be fully substituted with $CH_2COOH$ groups. $NH_2$ groups from, e.g., polyvinylamines or polyalkylenimines can be substituted with one or two $CH_2COOH$ group(s) per N atom, preferably with two $CH_2COOH$ groups per N atom.

The numbers of $CH_2COOH$ groups in polymer (A2) divided by the potential total number of $CH_2COOH$ groups, assuming one $CH_2COOH$ group per NH group and two $CH_2COOH$ groups per $NH_2$ group, will also be termed as "degree of substitution" in the context of the present invention.

The degree of substitution can be determined, for example, by determining the amine numbers (amine values) of polymer (A2) and its respective polyamine before conversion to the $CH_2COOH$-substituted polymer (A2), preferably according to ASTM D2074-07.

Examples of polyamines are polyvinylamine, polyalkylenepolyamine and in particular polyalkylenimines such as polypropylenimines and polyethylenimine.

Within the context of the present invention, polyalkylenepolyamines are preferably understood as meaning those polymers which comprise at least 6 nitrogen atoms and at least five $C_2$-$C_{10}$-alkylene units, preferably $C_2$-$C_3$-alkylene units, per molecule, for example pentaethylenhexamine, and in particular polyethylenimines with 6 to 30 ethylene units per molecule. Within the context of the present invention, polyalkylenepolyamines are to be understood as meaning those polymeric materials which are obtained by homo- or copolymerization of one or more cyclic imines, or by grafting a (co)polymer with at least one cyclic imine. Examples are polyvinylamines grafted with ethylenimine and polyimidoamines grafted with ethylenimine.

Preferred polymers (B) are polyalkylenimines such as polyethylenimines and polypropylenimines, polyethylenimines being preferred. Polyalkylenimines such as polyethylenimines and polypropylenimines can be linear, essentially linear or branched.

In one embodiment of the present invention, polyethylenimines are selected from highly branched polyethylenimines. Highly branched polyethylenimines are characterized by their high degree of branching (DB). The degree of branching can be determined, for example, by $^{13}C$-NMR spectroscopy, preferably in $D_2O$, and is defined as follows:

$$DB=D+T/D+T+L$$

with D (dendritic) corresponding to the fraction of tertiary amino groups, L (linear) corresponding to the fraction of secondary amino groups and T (terminal) corresponding to the fraction of primary amino groups.

Within the context of the present invention, highly branched polyethylenimines are polyethylenimines with DB in the range from 0.25 to 0.90.

In one embodiment of the present invention, polyethylenimine is selected from highly branched polyethylenimines (homopolymers) with an average molecular weight $M_w$ in the range from 600 to 75 000 g/mol, preferably in the range from 800 to 25 000 g/mol.

In another embodiment of the present invention, polyethylenimines are selected from copolymers of ethylenimine, such as copolymers of ethylenimine with at least one diamine with two $NH_2$ groups per molecule other than ethylenimine, for example propylene imine, or with at least one compound with three $NH_2$ groups per molecule such as melamine.

In one embodiment of the present invention, polymer (A2) is selected from branched polyethylenimines, partially or fully substituted with $CH_2COOH$ groups, partially or fully neutralized with $Na^+$.

Within the context of the present invention, polymer (A2) is used in covalently modified form, and specifically such that in total up to at most 100 mol-%, preferably in total 50 to 98 mol-%, of the nitrogen atoms of the primary and secondary amino groups of the polymer (A2)—percentages being based on total N atoms of the primary and secondary amino groups in polymer (A2)—have been reacted with at least one carboxylic acid such as, e.g., Cl—$CH_2COOH$, or at least one equivalent of formaldehyde and one equivalent of hydrocyanic acid or a salt thereof. Within the context of the present application, said reaction (modification) can thus be, for example, an alkylation. Most preferably, up to at most 100 mol-%, preferably in total 50 to 99 mol-%, of the nitrogen atoms of the primary and secondary amino groups of the polymer (A2) have been reacted with formaldehyde and hydrocyanic acid (or a salt thereof), for example by way of a Strecker synthesis. Tertiary nitrogen atoms of polyalkylenimine that may form the basis of polymer (A2) are generally not bearing a $CH_2COOH$ group.

Polymer (A2) may, for example, have an average molecular weight ($M_n$) of at least 500 g/mol; preferably, the average molecular weight of polymer (A2) is in the range from 500 to 1,000,000 g/mol, particularly preferably 800 to 50,000 g/mol, determined determination of the amine numbers (amine values), for example according to ASTM D2074-07, of the respective polyamine before alkylation and after and calculation of the respective number of $CH_2COOH$ groups. The molecular weight refers to the respective per-sodium salt.

In aqueous solutions according to the invention, the $CH_2COOH$ groups of polymer (A2) are partially or fully neutralized with alkali metal cations. The non-neutralized groups COOH can be, for example, the free acid. It is preferred that 90 to 100 mol-% of the $CH_2COOH$ groups of polymer (A2) are in neutralized form.

It is preferred that the neutralized $CH_2COOH$ groups of polymer (A2) are neutralized with the same alkali metal as compound (A).

$CH_2COOH$ groups of polymer (A2) may be neutralized, partially or fully, with any type of alkali metal cations, preferably with $K^+$ and particularly preferably with $Na^+$.

In one embodiment of the present invention, polymer (A2) is selected from partially or fully carboxymethylated polyethylenimine, fully or partially neutralized with alkali.

Inventive formulations additionally contain (B) at least one salt of at least one of the following acids: nitric acid, sulphuric acid, sulphamic acid, methanesulfonic acid, $C_1$-$C_2$-carboxylic acids, $C_2$-$C_4$-hydroxymonocarboxylic acids, $C_2$-$C_7$-dicarboxylic acids, unsubstituted or substituted with hydroxyl, and $C_4$-$C_6$-tricarboxylic acids, each unsubstituted or substituted with hydroxyl.

Examples of suitable $C_1$-$C_2$-carboxylic acids are formic acid and acetic acid.

Examples of suitable $C_2$-$C_4$-hydroxymonocarboxylic acids are hydroxyacetic acid, lactic acid, for example L-lactic acid, D-lactic acid and (D,L)-lactic acid, and α-hydroxybutyric acid, lactic acid being preferred.

Out of $C_2$-$C_7$-dicarboxylic acids, unsubstituted or substituted with hydroxyl, $C_3$-$C_6$-dicarboxylic acids are preferred, unsubstituted or substituted with hydroxyl.

Examples of $C_2$-$C_7$-dicarboxylic acids, unsubstituted or substituted with hydroxyl, are malonic acid, succinic acid, glutamic acid, adipic acid, pimelic acid, malic acid, tartaric acid, and mixtures of at least two of the foregoing, preferred are lactic acid, succinic acid, glutamic acid, adipic acid, and mixtures of at least two of the foregoing, particularly preferred are adipic acid and mixtures from succinic acid, glutamic acid and adipic acid.

Examples of $C_4$-$C_6$-tricarboxylic acids, each unsubstituted or substituted with hydroxyl, are 1,2,3-propanetricarboxylic acid and citric acid, citric acid being preferred.

In a preferred embodiment of the present invention, compound (B) is selected from the sodium and potassium salts of nitric acid, sulphuric acid, sulphamic acid, methanesulfonic acid, formic acid, acetic acid, citric acid, adipic acid, combinations of at least two of the foregoing, and from mixtures from succinic acid, glutamic acid and adipic acid.

Compound (B) is a salt, preferably an alkali metal salt. Alkali metal or alkali both refer to alkali metal cations such as lithium, sodium, potassium, rubidium and cesium and to combinations of at least two of the foregoing. Preferred alkali metals are sodium and potassium and combinations from sodium and potassium, for example 2:1 by mole to 10:1. Even more preferred is sodium. Traces—such as 100 ppm or less by weight—of alkali earth metals or transition metals such as Fe(+II) and Fe(+III) are neglected in the context of the present invention.

Inventive formulations additionally contain (C) at least one compound, hereinafter also being referred to as compound (C) or component (C), said compound (C) being selected from
  - (C1) phosphoric acid $C_2$-$C_{10}$-monoalkyl esters, in brief hereinafter also being referred to as compound (C1),
  - (C2) a $C_3$-$C_{10}$-alkynol, optionally alkoxylated with one to 10 alkoxide groups per hydroxyl group, in brief hereinafter also being referred to as compound (C2), and
  - (C3) a $C_4$-$C_{10}$-alkynediol, optionally alkoxylated with one to 10 alkoxide groups per hydroxyl group, in brief hereinafter also being referred to as compound (C3).

In one embodiment of the present invention, inventive formulations contain exactly one compound (C), thus either one compound (C1) or one compound (C2) or one compound (C3). In other embodiments of the present invention, inventive formulations contain two or more compounds (C), for example two or more compounds (C1) or two or more compounds (C2) or two or more compounds (C3). In yet another embodiment of the present invention, inventive formulations contain at least one compound (C2) and at least one compound (C3), or they contain at least one compound (C1) and at least one compound (C2), or they contain at least one compound (C1) and at least one compound (C3). Preferably, inventive formulations contain exactly one compound (C), or they contain either two or more compounds (C1) or two or more compounds (C2) or two or more compounds (C3).

Compound (C1) is selected from compounds according to the general formula $$(MO)_2P(=O)—OR^2,$$

with $R^2$ being selected from $C_2$-$C_{10}$-alkyl. $R^2$ may be, for example, methyl, ethyl, n-propyl, iso-propyl, n-butyl, isobutyl, sec.-butyl, n-pentyl, iso-pentyl, sec.-pentyl, iso-amyl, n-hexyl, iso-hexyl, n-heptyl, iso-heptyl, n-octyl, iso-octyl, n-nonyl, iso-nonyl, n-decyl, iso-decyl, and preferably $C_6$-$C_{10}$-alkyl.

M is defined as above.

Many inventive formulations that contain compound (C1) have a turbid or opaque or even slurry-like appearance. Despite of the appearance, the stability and low corrosivity is excellent.

In one embodiment of the present invention, compounds (C2) are compounds in accordance with the following formula $$HC{\equiv}C—CH_2—O(—CH_2—CHR^2—O—)_nH \quad (C2)$$

and compounds (C3) are compounds in accordance with the following formulae:

$$H(—O—CHR^2—CH_2)_n—O—CH_2—C≡C—CH_2—O(—CH_2—CHR^2—O—)_mH \quad (C3.1),$$

$$H(—O—CHR^2—CH_2)_n—O—CH_2—CH_2—C≡C—CH_2—CH_2—O(—CH_2—CHR^2—O—)_mH \quad (C3.4),$$

wherein $R^2$, in each case independently of one another, are same or different and selected from H and methyl and ethyl, preferably from H and methyl. Even more preferably, $R^2$ is methyl.

The indices n—and, if applicable m—independently of one another, are numbers from zero to 10, preferably zero to 5 and even more preferably 1 to 3. In the context of the present invention, the indices n—and, if applicable, m—are average values. Especially in embodiments when n—and, if applicable, m—is greater than 3 then the indices n—and, if applicable, m—may adopt the values of fractions like, for example, 3.5 or 4.2.

In a preferred embodiment of the present invention, compounds (C) are selected from those compounds (C2) wherein n is in the range of from 1 to 3 and $R^2$—or all $R^2$, if applicable—are methyl. In such embodiments, compound (C2) corresponds to propargyl alcohol, alkoxylated with 1 to 3 moles of propylene oxide per mole.

In another preferred embodiment of the present invention, compounds (C) are selected from 1,4-butindiol, alkoxylated with zero to 10, preferably zero to 5, and more preferably 0 to 3 molecules of ethylene oxide and/or propylene oxide per hydroxyl group. In such embodiments, compound (C3) corresponds to 1,4-butindiol, alkoxylated with 1 to 3 moles of propylene oxide per mole.

In one embodiment of the present invention, inventive formulations contain at least one active ingredient active ingredients other than component(s) (A), component(s) (B) and component(s) (C). Examples of active ingredients are at least one surfactant selected from anionic surfactants and non-ionic surfactants.

Examples of suitable anionic surfactants are alkali metal and ammonium salts of $C_8$-$C_{18}$-alkyl sulfates, of $C_8$-$C_{18}$-fatty alcohol polyether sulfates, of sulfuric acid half-esters of ethoxylated $C_4$-$C_{12}$-alkylphenols (ethoxylation: 1 to 50 mol of ethylene oxide/mol), $C_{12}$-$C_{18}$ sulfo fatty acid alkyl esters, for example of $C_{12}$-$C_{18}$ sulfo fatty acid methyl esters, furthermore of $C_{12}$-$C_{18}$-alkylsulfonic acids and of $C_{10}$-$C_{18}$-alkylarylsulfonic acids. Preference is given to the alkali metal salts of the aforementioned compounds, particularly preferably the sodium salts.

Further examples for suitable anionic surfactants are soaps, for example the sodium or potassium salts of stearoic acid, oleic acid, palmitic acid, ether carboxylates, and alkylether phosphates.

Preferred non-ionic surfactants are alkoxylated alcohols, di- and multiblock copolymers of ethylene oxide and propylene oxide and reaction products of sorbitan with ethylene oxide or propylene oxide, alkyl polyglycosides (APG), hydroxyalkyl mixed ethers and amine oxides.

Preferred examples of alkoxylated alcohols and alkoxylated fatty alcohols are, for example, compounds of the general formula (III)

(III)

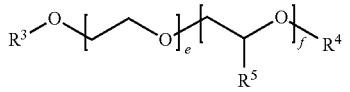

in which the variables are defined as follows:

$R^3$ is selected from $C_8$-$C_{22}$-alkyl, branched or linear, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^4$ is selected from $C_1$-$C_{10}$-alkyl, for example methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, $R^5$ is identical or different and selected from hydrogen and linear $C_1$-$C_{10}$-alkyl, preferably in each case identical and ethyl and particularly preferably hydrogen or methyl.

The variables e and f are in the range from zero to 300, where the sum of e and f is at least one, preferably in the range of from 3 to 50. Preferably, e is in the range from 1 to 100 and f is in the range from 0 to 30.

In one embodiment, compounds of the general formula (III) may be block copolymers or random copolymers, preference being given to block copolymers.

Other preferred examples of alkoxylated alcohols are, for example, compounds of the general formula (IV)

(IV)

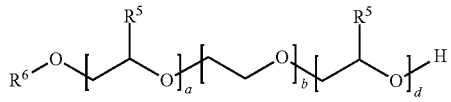

in which the variables are defined as follows:

$R^5$ are identical or different and selected from hydrogen and linear $C_1$-$C_0$-alkyl, preferably identical in each case and ethyl and particularly preferably hydrogen or methyl, $R^6$ is selected from $C_6$-$C_{20}$-alkyl, branched or linear, in particular n-$C_8H_{17}$, n-$C_{10}H_{21}$, n-$C_{12}H_{25}$, n-$C_{13}H_{27}$, n-$C_{15}H_{31}$, n-$C_{14}H_{29}$, n-$C_{16}H_{33}$, n-$C_{18}H_{37}$, a is a number in the range from zero to 10, preferably from 1 to 6, b is a number in the range from 1 to 80, preferably from 4 to 20, d is a number in the range from zero to 50, preferably 4 to 25.

The sum a+b+d is preferably in the range of from 5 to 100, even more preferably in the range of from 9 to 50.

Preferred examples for hydroxyalkyl mixed ethers are compounds of the general formula (V)

(V)

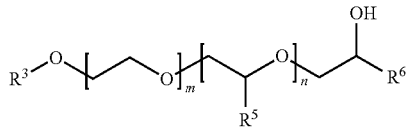

in which the variables are defined as follows:

$R^3$ is selected from $C_8$-$C_{22}$-alkyl, branched or linear, for example iso-$C_{11}H_{23}$, iso-$C_{13}H_{27}$, n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^5$ is identical or different and selected from hydrogen and linear $C_1$-$C_{10}$-alkyl, preferably in each case identical and ethyl and particularly preferably hydrogen or methyl, $R^6$ is selected from $C_6$-$C_{20}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl, isodecyl, n-dodecyl, n-tetradecyl, n-hexadecyl, and n-octadecyl.

The variables e and f are in the range from zero to 300, where the sum of e and f is at least one, preferably in the range of from 5 to 50. Preferably, e is in the range from 1 to 100 and f is in the range from 0 to 30.

Compounds of the general formula (IV) and (V) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl polyglycosides, especially linear $C_4$-$C_{16}$-alkyl polyglucosides and branched $C_8$-$C_{14}$-alkyl polyglycosides such as compounds of general average formula (VI) are likewise suitable.

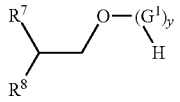

(VI)

wherein:

$R^7$ is $C_1$-$C_4$-alkyl, in particular ethyl, n-propyl or isopropyl, $R^8$ is $—(CH_2)_2—R^7$, $G^1$ is selected from monosaccharides with 4 to 6 carbon atoms, especially from glucose and xylose, y in the range of from 1.1 to 4, y being an average number, Further examples of non-ionic surfactants are compounds of general formula (VII) and (VIII)

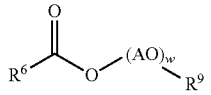

(VII)

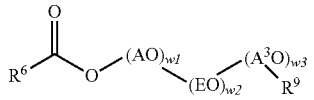

(VIII)

AO is selected from ethylene oxide, propylene oxide and butylene oxide,

EO is ethylene oxide, $CH_2CH_2$—O, $R^6$ is selected from $C_6$-$C_{20}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl, isodecyl, n-dodecyl, n-tetradecyl, n-hexadecyl, and n-octadecyl, $R^9$ selected from $C_8$-$C_{18}$-alkyl, branched or linear, $A^3O$ is selected from propylene oxide and butylene oxide, w is a number in the range of from 15 to 70, preferably 30 to 50, w1 and w3 are numbers in the range of from 1 to 5, and w2 is a number in the range of from 13 to 35.

Mixtures of two or more different nonionic surfactants selected from the foregoing may also be present.

In an alternative embodiment of the present invention, inventive formulations do not contain active ingredients other than component(s) (A), component(s) (B) and component(s) (C).

In preferred embodiments of the present invention, inventive formulations have a total solids content in the range of from 20 to 45%, preferably 30 to 40%. The total solids content includes component(s) (A), component(s) (B), component(s) (C), and, if applicable, further active ingredients such as surfactants but excludes water of crystallization. Inventive formulations with a total solids content lower than 20% lead to a transport of too much water which is unsatisfactory. Inventive formulations with a higher total solids content easily lead to deposits of active ingredients, especially of compound (A1), if compound (A1) is selected from racemic MGDA.

In one embodiment of the present invention, inventive formulations comprise in total in the range of from 10 to 45% by weight complexing agent (A), preferably from 20 to 45%, and more preferably from 30 to 45%;

in total in the range of from 1 to 15% by weight salt (B), preferably from 3 to 10% and more preferably from 4 to 8%;

in total in the range of from 0.01 to 1.5% by weight compound (C), preferably from 0.05 to 1%, and more preferably from 0.1 to 0.7%;

percentages referring to the entire aqueous formulation.

In embodiments wherein surfactant (D) is employed, the preferred amount is in the range of from 0.5 to 10% referring to the entire respective aqueous formulation.

Inventive formulations show excellent stability. Especially, inventive formulations show only low tendency for corrosion, especially towards aluminium. They may be stored in aluminium drums or aluminium vessels, and they may be shipped and transferred in devices of which at least a surface or part of a surface that is exposed to the respective inventive formulation is made from aluminium.

Another aspect of the present invention is drawn to the use of an inventive aqueous formulation as or for the manufacture of a cleaner, hereinafter also referred to as inventive use.

Another aspect of the present invention is drawn to a process for manufacturing a cleaner, for example a hard surface cleaner, said process comprising mixing at least one inventive aqueous formulation with water. Said mixing may be performed at any temperature but preferred is ambient temperature. A dilution with a dilution factor in the range of from 1:2 up to 1:50 is possible. The water to be added may have any temperature, for example 5 to 30° C.

In the context of the present invention, the term "cleaners" includes cleaners for home care and for industrial or institutional applications. The term "cleaners" includes compositions for dishwashing, especially hand dishwash and automatic dishwashing and ware-washing, and compositions for hard surface cleaning such as, but not limited to compositions for bathroom cleaning, kitchen cleaning, floor cleaning, descaling of pipes, window cleaning, car cleaning including truck cleaning, furthermore, open plant cleaning, cleaning-in-place, metal cleaning, disinfectant cleaning, farm cleaning, high pressure cleaning, but not laundry detergent compositions.

Other ingredients may also be added to a cleaner and especially to a hard surface cleaner. Such other ingredients include, but are not limited to dyestuffs, fragrances, biocides, and dispersing agents.

Another aspect of the present invention is drawn to a manufacturing process, hereinafter also referred to as inventive manufacturing process. The inventive manufacturing process is a process for manufacturing an inventive formulation. Preferably, the inventive manufacturing process is carried out by mixing (A) at least one organic complexing agent selected from
  (A1) alkali metal salts of aminopolycarboxylic acids and
  (A2) polymers bearing at least two —$CH_2$—N ($CH_2COOH$)-units per molecule, partially or fully neutralized with alkali, (B) at least one salt of at least one of the following acids: nitric acid, sulphuric acid, sulphamic acid, methanesulfonic acid, $C_1$-$C_2$-carboxylic acids, $C_2$-$C_4$-hydroxymonocarboxylic acids, $C_2$-$C_7$-dicarboxylic acids, unsubstituted or substituted with hydroxyl, and $C_4$-$C_6$-tricarboxylic acids, each unsubstituted or substituted with hydroxyl, (C) at least one compound selected from
  (C1) phosphoric acid $C_2$-$C_{10}$-monoalkyl esters,
  (C2) a $C_3$-$C_{10}$-alkynol, alkoxylated with one to 10 alkoxide groups per hydroxyl group, and
  (C3) a $C_4$-$C_{10}$-alkynediol, alkoxylated with one to 10 alkoxide groups per hydroxyl group, in one or more steps with water.

The inventive manufacturing process may be carried out at any temperature. Preferred temperatures for carrying out the inventive manufacturing process are in the range of from 10 to 70° C., preferably 15 to 45° C.

The inventive manufacturing process may be carried out at any pressure but normal pressure is preferred. It is possible to mix the components in any order. It is preferred, though, to add the corresponding acid of salt (B) to an aqueous solution of complexing agent (A). Further components such as compound (C) are added thereafter. Water for the purpose of dilution may be added at any stage. The inventive manufacturing process is very suitable for making invent aqueous solutions.

The invention is further illustrated by working examples.

General Remark:

Aqueous solutions were prepared by mixing the following components:

In accordance with Table 1, a beaker was charged with 40% by weight aqueous solution of complexing agent (A). Then, the corresponding acid of salt (B) was added until the respective pH value was reached. Subsequently, ten percent water and the amount of compound (C) according to Table 1 were added. The respective inventive solutions—or the respective comparative solutions, as the case may be—were obtained.

The corrosion tests were performed as follows:

An amount of 100 ml of inventive solution or comparative solution, as the case may be in each case hereinafter referred to as "test solution"—was put into a sealable plastic beaker. An aluminium plate with the following properties: 99.5% Al, size 20 mm×50 mm×1 mm, density 2.7 g/$cm^3$, obtained from Rocholl GmbH, 74858 Aglasterhausen, Germany, was cleaned with acetic acid ethylester, dried and weighed and then immediately placed into the test solution in such a way that it is completely immersed and the main surfaces had no contact with the bottom or the wall of the beaker. The beaker was then placed in a heating chamber at 55° C.

After 7 days the aluminium plate was removed from the test solution, cleaned thoroughly with distilled water and a sponge, dried and weighed.

The weight loss per year [mm per year] is calculated as follows:

Weight loss (mm/year) is the weight loss in G as determined, multiplied by 365 days/year and by 10, and normalized by division by 2.7 g/$cm^3$, by the surface of 2.14 $cm^2$, and by 7 days.

I. Manufacture of Inventive Formulations and of Comparative Formulations

The following substances were used:

(A1.1): (D,L)-MGDA-$Na_3$ as 40% by weight aqueous solution (A1.2): (D,L)-GLDA-$Na_4$ as 40% by weight aqueous solution (A1.3): NTA-$Na_3$ as 40% by weight aqueous solution (A1.4): EDTA-$Na_4$ as 40% by weight aqueous solution (A1.5): DTPA-$Na_5$ as 40% by weight aqueous solution (B.1): citric acid in bulk, (B.2): methyl sulfonic acid, as 70% by weight aqueous solution (B.3): sulfuric acid as 96% aqueous solution (B.4): nitric acid as 65% by weight aqueous solution (B.5): acetic acid (B.6): formic acid (C1.1): $(MO)_2P(=O)$—$OC_6$-$C_{10}$-alkyl and MO-P(=O)—$(OC_6$-$C_{10}$-alkyl$)_2$, $C_6$-$C_{10}$-alkyl being a combination from the respective normal alkyl groups (C2.1): HC≡C—$CH_2$—O(—PO—)$_{1.3}$H (PO: propylene oxide). N=1.3 refers to the average value.

As comparative corrosion inhibitors, the following substances were used:

C-(C.10)

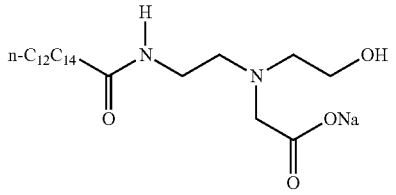

C-(C.11)

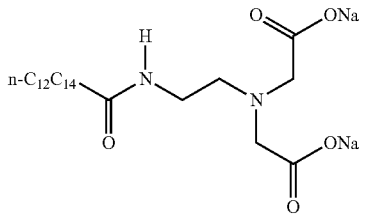

C-(C.12)

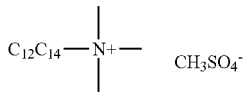

The following inventive formulations (AF) and comparative formulations C-(AF) were made, see Table 1.

II. Results of Corrosion Tests

The average aluminium abrasion was determined as explained above. The results are summarized in Table 1. They are average values of 2 tests.

TABLE 1

Composition and corrosion test results of inventive formulations and comparative formulations

| Name | Ingredient | [g] | % by weight tel quel | % by weight (active ingredient) | pH value | Al abrasion [mg/a] |
|---|---|---|---|---|---|---|
| C-(AF.1) | (A1.1) | 164.3 | 82.2 | 32.9 | 9.0 | 1.74 |
| | (B.1) | 15.7 | 7.9 | 7.9 | | |
| | water | 20.0 | 10.0 | | | |
| (AF.2) | (A1.1) | 181.2 | 87.0 | 34.8 | 9.0 | 0.49 |
| | (B.1) | 17.3 | 8.3 | 8.3 | | |
| | (C2.1) | 1.5 | 0.7 | 0.5 | | |
| | Water | 8.3 | 4.0 | | | |
| C-(AF.3) | (A1.1) | 180.6 | 72.7 | 29.1 | 9.0 | 4.9 |
| | (B.1) | 17.3 | 6.9 | 6.9 | | |
| | C-(C.10) | 2.1 | 0.9 | 0.9 | | |
| | Water | 48.6 | 19.5 | | | |
| C-(AF.4) | (A1.1) | 180.2 | 72.5 | 29.0 | 9.0 | 2.59 |
| | (B.1) | 17.2 | 6.9 | 6.9 | | |
| | C-(C.11) | 2.5 | 1.0 | 0.5 | | |
| | Water | 33.9 | 13.6 | | | |
| C-(AF.5) | (A1.1) | 154.3 | 85.7 | 34.3 | 9.0 | 7.57 |
| | (B.2) | 25.7 | 14.3 | 10.0 | | |
| C-(AF.6) | (A1.1) | 154.3 | 77.1 | 34.3 | 9.0 | 9.12 |
| | (B.2) | 25.7 | 12.9 | 10.0 | | |
| | water | 20.0 | 10.0 | | | |
| (AF.7) | (A1.1) | 170.2 | 83.5 | 33.4 | 9.0 | 0.76 |
| | (B.2) | 28.3 | 13.9 | 9.7 | | |
| | (C2.1) | 1.5 | 0.7 | 0.5 | | |
| | Water | 3.7 | 1.8 | | | |
| C-(AF.8) | (A1.1) | 169.6 | 72.3 | 28.9 | 9.0 | 4.89 |
| | (B.2) | 28.3 | 11.4 | 8.0 | | |
| | C-(C.10) | 2.1 | 0.9 | 0.4 | | |
| | Water | 34.7 | 13.9 | | | |
| C-(AF.9) | (A1.1) | 169.3 | 72.3 | 28.9 | 9.0 | 9.83 |
| | (B.2) | 28.2 | 11.4 | 8.0 | | |
| | C-(C.11) | 2.5 | 0.9 | 0.4 | | |
| | Water | 33.9 | 13.9 | | | |
| C-(AF.10) | (A1.1) | 168.6 | 82.1 | 32.8 | 9.0 | 7.42 |
| | (B.1) | 28.1 | 13.7 | 9.6 | | |
| | C-(C.12) | 2.5 | 1.2 | 0.4 | | |
| | water | 6.2 | 3.0 | | | |
| (AF.11) | (A1.1) | 171.3 | 85.3 | 34.1 | 9.0 | 0.01 |
| | (B.1) | 28.6 | 14.2 | 10.0 | | |
| | (C1.1) | 1.0 | 0.5 | 0.5 | | |
| (AF.12) | (A1.1) | 171.3 | 73.3 | 29.3 | 9.0 | 0.62 |
| | (B.1) | 28.6 | 12.2 | 8.5 | | |
| | (C1.1) | 0.1 | 0.04 | 0.04 | | |
| | Water | 33.9 | 14.5 | | | |
| C-(AF.13) | (A1.1) | 500 | 80 | 32.0 | 9.0 | 8.72 |
| | (B.4) | 62.5 | 10 | 6.5 | | |
| | Water | 62.5 | 10 | | | |
| (AF.14) | (A1.1) | 176.5 | 79.4 | 31.8 | 9.0 | 0.62 |
| | (B.4) | 22.0 | 9.9 | 6.4 | | |
| | (C2.1) | 1.5 | 0.7 | 0.4 | | |
| | Water | 22.2 | 10.0 | | | |
| C-(AF.15) | (A1.1) | 500.0 | 84.2 | 33.7 | 9.0 | 8.40 |
| | (B.5) | 34.6 | 5.8 | 5.8 | | |
| | Water | 59.4 | 10.0 | | | |
| (AF.16) | (A1.1) | 185.7 | 83.6 | 33.4 | 9.0 | 0.95 |
| | (B.5) | 12.8 | 5.8 | 5.8 | | |
| | (C2.1) | 1.5 | 0.7 | 0.4 | | |
| | Water | 22.2 | 10.0 | | | |
| C-(AF.17) | (A1.1) | 500.0 | 85.1 | 34.0 | 9.0 | 8.89 |
| | (B.6) | 28.9 | 4.9 | 4.9 | | |
| | Water | 58.8 | 10.0 | | | |
| (AF.18) | (A1.1) | 187.7 | 84.5 | 33.8 | 9.0 | 0.88 |
| | (B.6) | 10.8 | 4.9 | 4.9 | | |
| | (C2.1) | 1.5 | 0.7 | 0.4 | | |
| | Water | 22.2 | 10.0 | | | |
| C-(AF.19) | (A1.1) | 500.0 | 85.0 | 34.0 | 9.0 | 10.59 |
| | (B.3) | 29.2 | 5.0 | 4.8 | | |
| | Water | 58.8 | 10.0 | | | |
| (AF.20) | (A1.1) | 187.6 | 84.4 | 33.8 | 9.0 | 1.27 |
| | (B.3) | 11.0 | 4.9 | 4.9 | | |
| | (C2.1) | 1.5 | 0.7 | 0.4 | | |
| | Water | 22.2 | 10.0 | | | |
| C-(AF.21) | (A1.2) | 495.0 | 83.8 | 33.5 | 9.0 | 9.80 |
| | (B.2) | 36.7 | 6.2 | 4.3 | | |
| | Water | 59.1 | 10.0 | | | |

TABLE 1-continued

Composition and corrosion test results of inventive formulations and comparative formulations

| Name | Ingredient | [g] | % by weight tel quel | % by weight (active ingredient) | pH value | Al abrasion [mg/a] |
|---|---|---|---|---|---|---|
| (AF.22) | (A1.2) | 184.8 | 83.2 | 33.3 | 9.0 | 1.39 |
| | (B.2) | 13.7 | 6.2 | 4.3 | | |
| | (C2.1) | 1.5 | 0.7 | 0.4 | | |
| | Water | 22.2 | 10.0 | | | |
| C-(AF.23) | (A1.1) | 500.0 | 78.0 | 31.2 | 9.0 | 5.93 |
| | (B.2) | 77.2 | 12.0 | 8.4 | | |
| | Water | 64.1 | 10.0 | | | |
| (AF.24) | (A1.1) | 184.8 | 77.4 | 31.0 | 9.0 | 0.08 |
| | (B.2) | 13.7 | 11.9 | 8.4 | | |
| | (C2.1) | 1.5 | 0.7 | 0.4 | | |
| | Water | 22.2 | 10.0 | | | |
| C-(AF.25) | (A1.1) | 191.9 | 86.4 | 34.5 | 11.0 | 20.5 |
| | (B.2) | 6.6 | 3.0 | 2.1 | | |
| | (C1.1) | 1.5 | 0.7 | 0.4 | | |
| | Water | 22.2 | 10.0 | | | |

The invention claimed is:

1. An aqueous formulation, comprising:

(A) an organic complexing agent comprising (A1) an alkali metal salt of an aminopolycarboxylic acid, (A2) a polymer bearing at least two —$C_2$—$N(CH_2COOH)$- units per molecule, at least partially neutralized with alkali, or a mixture of two or more of any of these;

(B) an acid salt comprising, in salt form, nitric acid, sulfuric acid, sulfamic acid, methanesulfonic acid, a $C_1$-$C_2$-carboxylic acid, a $C_2$-$C_4$-hydroxymonocarboxylic acid, a $C_2$-$C_7$-dicarboxylic acid, a $C_4$-$C_6$-tricarboxylic acid, the di and tri carboxylic acids being optionally substituted with hydroxyl, or a mixture of two or more of any of these; and (C) a compound of formula (i), a compound of formula (ii), a compound of formula (iii), and/or a compound of formula (iv)

$$(MO)_2P(=O)—OR^2 \quad \text{(i)},$$

$$HC{\equiv}C—CH_2—O(—CH_2—CHR^3—O—)_nH \quad \text{(ii)},$$

$$H(—O—CHR^3—CH_2)_n—O—CH_2—C{\equiv}C—CH_2—O(—CH_2—CHR^3—O—)_mH \quad \text{(iii), and/or}$$

$$H(—O—CHR^3—CH_2)_n—O—CH_2—CH_2—C{\equiv}C—CH_2—CH_2—O(—CH_2—CHR^3—O—)_mH \quad \text{iv)},$$

$R^2$ being methyl, ethyl, n-propyl, iso-propyl, n-butyl, isobutyl, sec-butyl, n-pentyl, iso-pentyl, sec-pentyl, iso-amyl, or $C_6$-$C_{10}$-alkyl, $R^3$ being independently H, methyl, or ethyl, m and n being independently in a range of from 1 to 4.2, and M being independently Na or K, wherein (C) is present in an amount from greater than 0 wt. % to 1.5 wt. %, further wherein the aqueous formulation has a pH value in a range of from 7.5 to 10.

2. The formulation of claim 1, having a pH value in a range of from 8.5 to 10.

3. The formulation of claim 1, having a total solids content in a range of from 20 to 45%.

4. The formulation of claim 1, wherein the organic complexing agent (A1) is present and comprises an alkali metal salt of methylglycine diacetic acid, glutamic acid diacetic acid, nitrilotriacetic acid, ethylendiamine tetraacetate, or diethylenamine triamine pentaacetate.

5. The formulation of claim 1, wherein the organic complexing agent (A2) is present and comprises an at least partially carboxymethylated polyethylenimine.

6. The formulation of claim 1, wherein the compound (C) comprises the compound of formula (ii), alkoxylated with 1 to 3 moles of ethylene oxide and/or propylene oxide per mole.

7. The formulation of claim 1, wherein the compound (C) comprises the compound of formula (iii), alkoxylated with 1 to 10 molecules of ethylene oxide and/or propylene oxide per hydroxyl group.

8. The formulation of claim 1, comprising:

from 10 to 45 wt. % of the complexing agent (A);

from 1 to 15 wt. % of the salt (B); and from 0.01 to 1.5 wt. % of the compound (C), percentages referring to an entire aqueous formulation.

9. The formulation of claim 1, wherein the complexing agent (A) comprises a sodium and/or potassium salt of the aminopolycarboxylic acid (A1).

10. The formulation of claim 1, wherein the complexing agent (A) is of formula (I):

$$[R^1—CH(COO)—N(CH_2—COO)_2]M_{3-x}H_x \quad \text{(I)},$$

wherein

M is independently an alkali metal cation, x is in a range of from zero to 0.8, and $R^1$ is $CH_2$—OH or $C_1$-$C_4$-alkyl.

11. The formulation of claim 1, wherein the complexing agent (A) is of formula (II):

$$[OOC—CH_2CH_2C—CH(COO)—N(CH_2—COO)_2]M_{4-x}H_x \quad \text{(II)},$$

wherein

M is independently an alkali metal cation, and x is in a range of from zero to 0.8.

12. The formulation of claim 1, further comprising:

an anionic surfactant, a non-ionic surfactant, or a mixture of two or more of any of these.

13. A cleaning formulation, comprising:

the formulation of claim 1.

14. A process for manufacturing a cleaning formulation, the process comprising:

mixing the formulation of claim 1 with water.

15. A process for manufacturing the formulation of claim 1, the process comprising:

mixing (A) the complexing agent (A), the acid salt (B), and the compound (C), in one or more steps with water.

16. An aluminum container, comprising the formulation of claim 1.

17. The formulation of claim 1, wherein the compound (C) comprises the compound of formula (i)

$$(MO)_2P(=O)—OR^2 \quad \text{(i)},$$

wherein $R^2$ is $C_6$-$C_{10}$-alkyl, and

M is independently Na or K.

18. The formulation of claim 1, wherein the compound (C) comprises the compound of formula (i)

$$(MO)_2P(=O)—OR^2 \quad \text{(i)},$$

wherein $R^2$ is methyl, ethyl, n-propyl, iso-propyl, n-butyl, isobutyl, sec-butyl, n-pentyl, iso-pentyl, sec-pentyl, iso-amyl, n-hexyl, iso-hexyl, n-heptyl, iso-heptyl, n-octyl, iso-octyl, n-nonyl, iso-nonyl, n-decyl, or iso-decyl, and M is independently Na or K.

19. The formulation of claim 1, wherein the compound (C) comprises the compound of formula (ii)

$$HC{\equiv}C—CH_2—O(—CH_2—CHR^3—O—)_nH \quad \text{(ii)},$$

wherein $R^3$ is independently H, methyl, or ethyl, and n is in a range of from 1 to 4.2.

20. The formulation of claim 1, wherein the compound (C) comprises the compound of formula (iii) and/or (iv)

$$H(—O—CHR^3—CH_2)_n—O—CH_2—C{\equiv}C—CH_2—O(—CH_2—CHR^3—O—)_mH \quad \text{(iii) and/or}$$

$$H(—O—CHR^3—CH_2)_n—O—CH_2—CH_2—C{\equiv}C—CH_2—CH_2—O(—CH_2—CHR^3—O—)_mH \quad \text{(iv)},$$

wherein $R^3$ is independently H, methyl, or ethyl, and m and n are independently in a range of from 1 to 4.2.

* * * * *